US006479926B1

(12) United States Patent
Awano et al.

(10) Patent No.: US 6,479,926 B1
(45) Date of Patent: Nov. 12, 2002

(54) CATHODE RAY TUBE

(75) Inventors: Takashi Awano, Fukaya (JP); Junichi Kimiya, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/486,729

(22) PCT Filed: Jul. 8, 1999

(86) PCT No.: PCT/JP99/03696

§ 371 (c)(1),
(2), (4) Date: Mar. 10, 2000

(87) PCT Pub. No.: WO00/03410

PCT Pub. Date: Jan. 20, 2000

(30) Foreign Application Priority Data

Jul. 10, 1998 (JP) ..... 10-195978
Jun. 28, 1999 (JP) ..... 11-181684

(51) Int. Cl.[7] ..... H01J 29/62; H01J 29/51

(52) U.S. Cl. ..... 313/414; 313/432; 313/449; 315/15

(58) Field of Search ..... 313/414, 432, 313/412, 449, 421, 441, 446; 315/382, 15, 382.1, 368.15, 368.16

(56) References Cited

U.S. PATENT DOCUMENTS 5,449,983 A * 9/1995 Sugawara et al. ..... 315/382
5,694,004 A * 12/1997 Kimiya et al. ..... 315/15
6,225,766 B1 * 5/2001 Ono et al. ..... 315/382

FOREIGN PATENT DOCUMENTS

JP 61-99249 5/1986
JP 2-72546 3/1990
JP 4147545 * 5/1992 ..... H01J/29/50
JP 4-147545 A 5/1992
JP 6-223738 A 8/1994
JP 7-220648 A 8/1995
JP 11-120934 A 4/1998
JP 10-162752 A 6/1998
JP 10-172465 A 6/1998
JP 11-126565 A 5/1999

* cited by examiner

*Primary Examiner*—Nimeshkumar D. Patel
*Assistant Examiner*—Thelma Sheree Clove
(74) *Attorney, Agent, or Firm*—Oblon, Spivak, McClelland, Maier & Neustadt, P.C.

(57) ABSTRACT

The electron gun of a cathode ray tube comprises a main electron lens portion consisting of at least four electrodes arranged in the order of first grid (5), second grid (6), third grid (7) and fourth grid (8). An intermediate first voltage and an anode voltage are applied to the first grid (5) and the fourth grid (8), respectively. A resistor (100) is connected at one end to the second grid (6) and at the other end to the third grid (7) positioned adjacent to the second grid, with the result that second and third voltages of substantially the same potential, which are intermediate between the first voltage and the anode voltage, are applied to the second grid and the third grid, respectively. These grids are arranged such that a second electrostatic capacitance between the second and third grids (6, 7) is smaller than any of a first electrostatic capacitance between the first and second grids (5, 6) and a third electrostatic capacitance between the third and fourth grids (7, 8). As a result, the lateral collapse phenomenon of the electron beam, which is brought about in a periphery of the screen by the difference in the lens magnification between the horizontal direction and the vertical direction, can be moderated, (making it possible to provide a cathode ray tube having satisfactory image characteristics over the entire region of the screen.

2 Claims, 7 Drawing Sheets

CATHODE RAY TUBE

TECHNICAL FIELD

The present invention relates to a cathode ray tube, particularly, to a cathode ray tube provided with an electron gun performing a dynamic astigmatic compensation.

BACKGROUND ART

In general, a color cathode ray tube comprises an envelope consisting of a panel P1 and a funnel P2 integrally fused to the panel P1, as shown in FIG. 1. A phosphor screen P3 (target) consisting of three phosphor layers emitting blue, green and red light rays, respectively, which are in the shape of stripes or dots, is formed on the inner surface of the panel P1. Also, a shadow mask P4 having a large number of apertures formed therethrough is mounted inside the phosphor screen P3 in a manner to face the phosphor screen P3. On the other hand, an electron gun P7 emitting three electron beams P6B, P6G, and P6R is arranged within a neck P5 of the funnel P2. The electron beams P6B, P6G, and P6R emitted from the electron gun P7 are deflected by horizontal and vertical deflection magnetic fields generated from a deflection yoke P8 mounted on the outside of the funnel P2. As a result, the phosphor screen P3 is scanned horizontally and vertically by these electron beams P6B, P6G, and P6R passing through the shadow mask P4 to strike the phosphor screen P4, thereby displaying a color picture image.

An in-line type color cathode ray tube of a self-convergence system is widely put to a practical use as a color cathode ray tube of the construction outlined above. In the in-line type color cathode ray tube, the electron gun P7 consists of an in-line type electron gun emitting the three electron beams P6B, P6G, and P6R aligned to form a row, i.e., a center beam P6G running on a single horizontal plane and a pair of side beams P6B and P6R running on both sides of the center beam P6G. The positions of the side beam holes in grids on the low voltage side and high voltage side of the main lens portion of the electron gun are deviated from each other to permit the three electron beams to be converged in the center of the screen. Also, the horizontal deflection magnetic field generated from the deflection yoke P8 is made to be of a pin cushion type, and a vertical deflection magnetic field generated from the deflection yoke P8 is made to be of a barrel type. By these particular constructions, the three electron beams P6B, P6G, P6R arranged to form a single row are self-converged on the entire region of the screen to provide the in-line type color cathode ray tube of a self-convergence system.

In the in-line type color cathode ray tube of the self-convergence system, the electron beam passing through a non-uniform magnetic field generally receives astigmatism and, thus, strains 11H and 11V are imparted to the electron beam as shown in FIG. 2A. As a result, the beam spot 12 of the electron beam in a periphery of the phosphor screen is distorted as shown in FIG. 2B. The deflecting distortion received by the electron beam, which is generated because the electron beam is put in an excessively focused state in the vertical direction, gives rise to a large halo (blurring) 13 in the vertical direction, as shown in FIG. 2B. The deflecting distortion received by the electron beam is increased with increase in the size of the tube and with increase in the deflecting angle so as to markedly deteriorate the resolution at the periphery of the phosphor screen.

Means for overcoming the deterioration of the resolution caused by the deflecting distortion is disclosed in, for example, Japanese Patent Disclosure (Kokai) No. 61-99249 and Japanese Patent Disclosure No. 2-72546. The electron gun disclosed in each of these prior arts is basically constructed as shown in FIG. 3. As shown in the drawing, the electron gun comprises first grid G1 to fifth grid G5. Also, an electron beam-generating section GE, a quadrupole lens QL, and a final focusing lens EL are formed in the order mentioned in the running direction of the electron beam. The quadrupole lens QL for each electron gun is formed by forming symmetrical electron beam holes 14*a*, 14*b*, 14*c* and 15*a*, 15*b*, 15*c* through the mutually facing surfaces of the adjacent electrode G3 and G4, as shown in FIGS. 4A and 4B, respectively. By allowing these quadrupole lens QL and the final focusing lens EL to be changed in synchronism with the change in the magnetic field generated from the deflection yoke, the electron beam deflected toward the periphery of the screen can be prevented from receiving the deflecting distortion of the deflecting magnetic field and, thus, from being markedly distorted. As a result, satisfactory beam spots can be obtained over the entire region of the screen.

The correcting means disclosed in the prior arts certainly makes it possible to eliminate the halo portion in the vertical direction of the electron beam spot. However, since a strong deflecting distortion is generated by the deflection yoke in the periphery of the screen, it is impossible to correct the phenomenon of the lateral deformation of the electron beam spot.

The problem inherent in the conventional electron gun will now be described with reference to FIG. 5 showing the lens operation of the conventional electron gun. Solid lines in FIG. 5 denote the orbit and lens function of the electron beam where the electron beam is focused on the center of the screen. Also, broken lines in FIG. 5 denote the orbit and lens function of the electron beam where the electron beam is focused in a periphery of the screen. In the conventional electron gun, a quadrupole lens QL is arranged on the side of the cathode of the main electron lens EL, as shown in FIG. 5. Where the electron beam is directed toward the center of the screen, the electron beam is focused on the screen by only the function of the main electron lens EL denoted by the solid line. On the other hand, if the electron beam is deflected toward a periphery of the screen, a deflecting lens DYL is generated by the deflecting magnetic field as denoted by the broken line in FIG. 5.

In general, a self-convergence type deflection magnetic field is utilized in a color cathode ray tube. Therefore, the focusing force is not changed in the horizontal direction (H), and a focusing lens as a deflection lens DYL is generated in only the vertical direction (V).

Incidentally, FIG. 5 is intended to point out the problem inherent in the self-convergence type deflecting magnetic field and, thus, the lens function of the deflecting magnetic field in the horizontal direction, i.e., within a horizontal plane, is not shown in the drawing.

When the deflecting lens DYL is generated, that is, when the electron beam is deflected toward a periphery of the screen, the electron lens EL is weakened as denoted by the broken line, and the quadrupole lens QL1 is generated to compensate for the focusing function in the horizontal direction (H), as denoted by the broken line. Also, the electron beam is allowed to run through the orbit denoted by the broken line so as to be focused on a periphery of the screen. When the electron beam is directed to the center of the screen, the principle plane of the lens for focusing the electron beam in the horizontal direction (H), i.e., within a horizontal plane (imaginary center of the lens, i.e., cross point between the orbit of the electron beam emitted from the electron gun and the orbit of the electron beam incident on the phosphor screen) is on a principle plane PPA. When the electron beam is deflected toward a periphery of the screen to generate a quadrupole lens, the principle plane in the horizontal direction (H) is moved to a principle plane PPB interposed between the main electron lens EL and the quadrupole lens QL1. Also, the position of the principle plane in the vertical direction (V) is moved from the principle plane PPA to the principle plane PPC. It follows that the position of the principle plane in the horizontal direction is moved backward from the principle plane PPA to the principle plane PPB, leading to a poor magnification. On the other hand, the principle plane PPA in the vertical direction is moved forward to the principle plane PPC so as to improve the magnification. As a result, a difference in magnification is generated between the horizontal direction and the vertical direction so as to elongate the electron beam spot in a lateral direction (lateral collapse or deformation phenomenon) in a periphery of the screen.

DISCLOSURE OF THE INVENTION

The present invention, which has been achieved in view of the problems described above, is intended to eliminate or moderate the lateral collapse phenomenon of the electron beam occurring in a periphery of the screen because of the difference in the lens magnification between the horizontal and vertical directions so as to obtain satisfactory image characteristics over the entire region of the screen.

According to one embodiment of the present invention, there is provided a cathode ray tube, comprising at least an electron gun including an electron beam forming section for forming and emitting at least one electron beam and a main electron lens portion for accelerating and focusing the electron beam, and a deflection yoke for generating a deflecting magnetic field for deflecting the electron beam emitted from the electron gun in horizontal and vertical directions on a screen to have the screen scanned by the deflected electron beam, wherein:

- the main electron lens portion consists of at least four electrodes arranged in the order of first, second, third and fourth grids;
- an intermediate first voltage is applied to the first grid and an anode voltage is applied to the fourth grid;
- the second and third grids that are positioned adjacent to each other are connected to each other via a resistor;
- second and third voltages higher than the first voltage and lower than the anode voltage are applied to the second and third grids, respectively;
- these first to fourth grids are arranged such that a second electrostatic capacitance between the second and third grids is smaller than any of a first electrostatic capacitance between the first and second grids and a third electrostatic capacitance between the third and fourth grids;
- a first lens region is formed between the first and second grids;
- a third lens region is formed between the third and fourth grids;
- a second lens region is formed between the second and third grids; and
- an asymmetric lens is formed in the second lens region.

In the cathode ray tube of the present invention, the electron beam has an electron lens system as shown in FIG. 12 and depicts an electron beam orbit under the lens function of the lens system. The solid lines in FIG. 12 denote the electron beam orbit and the lens function when the electron beam is focused in the center of the screen. Also, the broken lines denote the electron beam orbit and the lens function when the electron beam is focused on a periphery of the screen. As shown in FIG. 12, a quadrupole lens QL1 is formed in a central portion of a main electron lens EL in the electron gun of the present invention. When the electron beam is directed to the center of the screen, the quadrupole lens QL1 performs a diverging function in the horizontal direction and a focusing function in the vertical direction, as denoted by the solid lines. When the electron beam is deflected toward a periphery of the screen, the quadrupole lens QL1 performs a focusing function in the horizontal direction and a diverging function in the vertical direction, as denoted by the broken lines.

Since the quadrupole lens QL1 forms a diverging lens in the horizontal direction, i.e., within a horizontal plane, and a focusing lens in the vertical direction, i.e., within a vertical plane, when the electron beam is directed to the center of the screen, the main electron lens EL forms a substantially cylindrical lens having a strong focusing force in the horizontal direction so as to compensate for the difference in focus between the horizontal and vertical planes. If the electron beam is deflected toward a periphery of the screen, the main electron lens EL is weakened as a whole and is operated to cancel the lens function of the quadrupole lens QL1 in the horizontal direction.

In this case, the orbit in the vertical direction of the electron beam is as denoted by a broken line in FIG. 12. On the other hand, the orbit in the horizontal direction of the electron beam is as in the case where the electron beams are focused on the center of the screen because the position of the quadrupole lens and the position of the main electron lens are substantially coincident with each other.

Therefore, the principle plane of the lens (imaginary center of lens, i.e., cross point between the orbit of the beam emitted from the electron gun and the orbit of the beam incident on the screen) for focusing the electron beam in the horizontal direction (H) at the time when the electron beam is in the center of the screen is equal to that at the time when the electron beam is deflected toward the periphery of the screen (principle plane A'=principle plane B'). In the vertical direction, the position of the principle plane is moved forward by the generation of a DY lens. In the conventional electron gun, the quadrupole lens QL1 is positioned closer to the cathode than the main electron lens EL. The electron beam is diverged by the quadrupole lens in the vertical direction, and the orbit of the electron beam extends through a point away from the axis of the main electron lens EL to cause the position C of the principle plane to be moved forward. In the electron gun of the present invention, however, the quadrupole lens QL1 is formed within the main electron lens EL. As a result, the orbit of the electron beam incident on the main electron lens EL remains unchanged and, thus, the principle plane C' in the vertical direction is moved to a position closer to the cathode than the principle plane C of the conventional electron gun. As a result, the magnification in the vertical direction is not larger than that in the conventional electron gun and, thus, the vertical diameter of the electron beam is not appreciably collapsed in the periphery of the screen.

Therefore, the amounts of deviation in the positions of the principle planes in the horizontal and vertical directions at the periphery of the screen are smaller in the electron gun of the present invention than in the conventional electron gun (magnifications in the vertical and horizontal directions are poor and satisfactory, respectively). As a result, the phenomenon of the lateral collapse or deformation of the electron beam at the periphery of the screen is suppressed to make it possible to obtain an electron beam having a substantially circular cross section.

As described above, the electron gun specified in the present invention makes it possible to obtain a cathode ray tube free from a lateral collapse of the electron beam at the periphery of the screen and exhibiting a satisfactory resolution over the entire region of the screen. Further, the second and third grids are connected to a resistor arranged in the vicinity of the electron gun. The anode voltage applied to the fourth grid is divided by the resistor, and the divided voltage is applied to these second and third grids, making it unnecessary to apply an extra voltage from outside the cathode ray tube. As a result, a cathode ray tube of a high quality as described above can be obtained easily.

It should also be noted that an AC voltage component is applied to the first grid. As a result, an AC voltage is overlapped with the DC voltage applied to each of the second and third grids via the electrostatic capacitance between adjacent electrodes. What should be noted is that a quadrupole lens is formed within the main lens between the second and third grids by the potential difference generated in this stage between the second and third grids.

Further, since the electrostatic capacitance between the second and third grids is smaller than any of the electrostatic capacitance between the first and second grids and the electrostatic capacitance between the third and fourth grids, the AC component generated by the AC component applied to the first grid and applied to the second grid is larger than that in the case where the electrostatic capacitance between the second and third grids is equal to or larger than any of the electrostatic capacitance between the first and second grids and the electrostatic capacitance between the third and fourth grids. Also, the AC component generated by the AC component applied to the first grid and applied to the third grid is diminished. Therefore, the potential difference between the second and third grids is increased. It follows that the AC voltage component applied to the first grid can be effectively utilized for formation and operation of the quadrupole lens formed between the second and third grids so as to diminish the AC component applied to the first grid.

Further, the second and third grids are connected to a resistor arranged in the vicinity of the electron gun. The anode voltage applied to the fourth grid is divided by the resistor, and the divided voltage is applied to these second and third grids, making it unnecessary to apply an extra voltage from outside the cathode ray tube. As a result, a cathode ray tube of a high quality as described above can be obtained easily.

BEST MODE FOR CARRYING OUT THE INVENTION

The electron gun of a cathode ray tube according to one embodiment of the present invention will now be described with reference to the accompanying drawings.

Figure 6A:
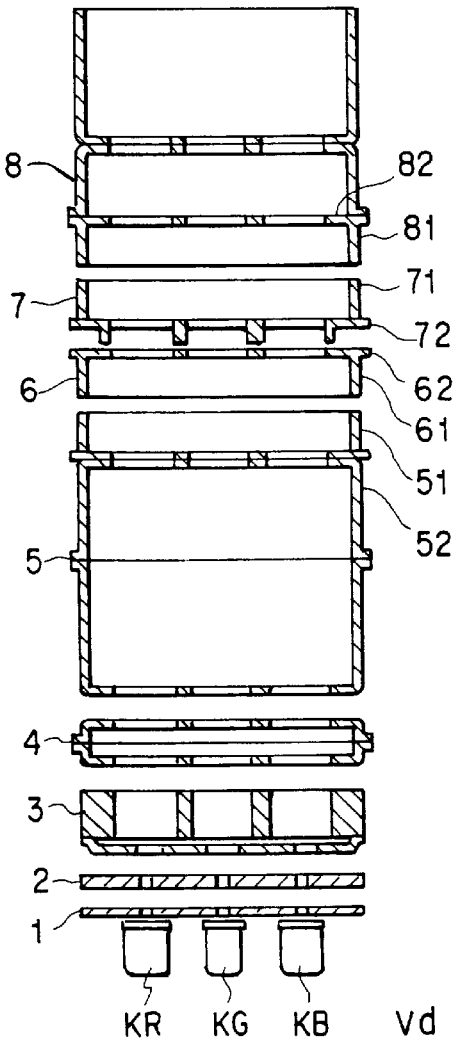
FIGS. 6A and 6B are cross sectional views each showing the construction of the electron gun mounted in a cathode ray tube according to one embodiment of the present invention.
Figure 6B:
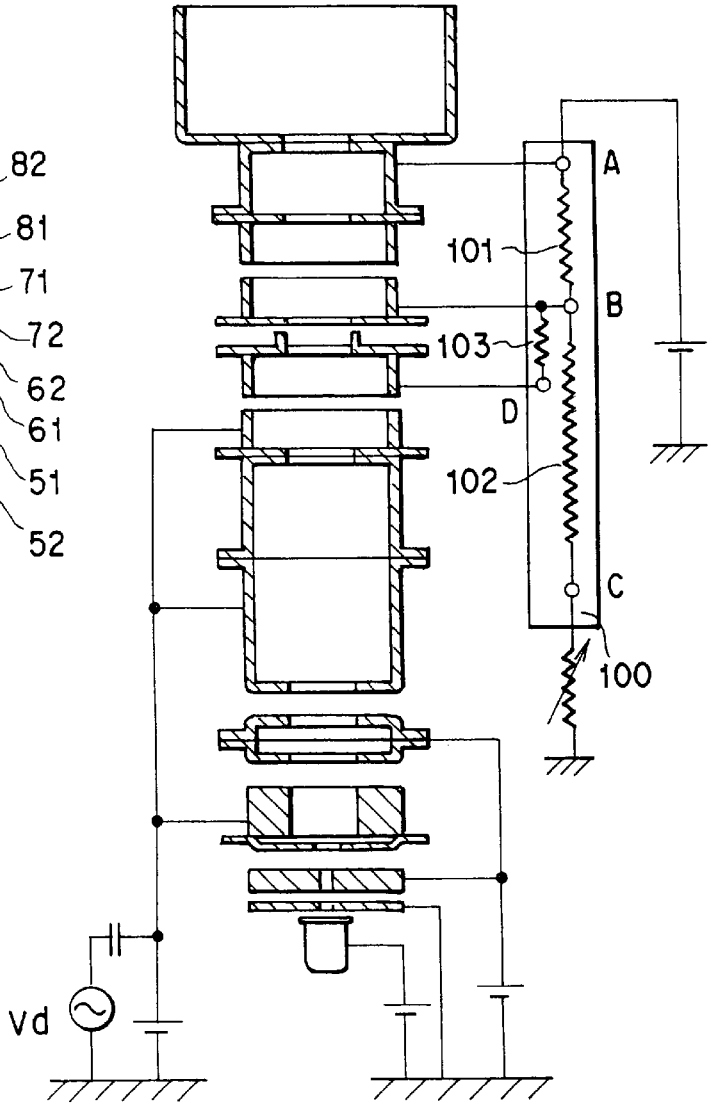

FIGS. 6A and 6B are cross sectional views schematically showing the construction of the electron gun portion of a cathode ray tube according to one embodiment of the present invention. As shown in FIG. 6A, three cathodes KB, KG, KR each housing a heater (not shown) and emitting an electron beam are fixed to and supported by an insulating support (not shown) together with a first grid 1, a second grid 2, a third grid 3, a fourth grid 4, a fifth grid 5, a sixth grid 6, a seventh grid 7 and an eighth grid 8. Convergence cups are arranged in the order mentioned within the insulating support.

Figure 7A:
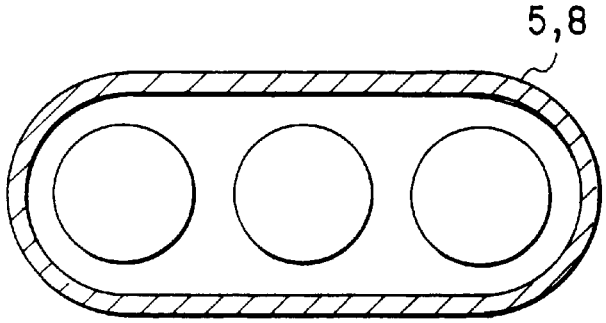
FIGS. 7A to 7D are plan views showing the shapes of the electrodes included in the electron gun shown in FIG. 6.
Figure 7B:
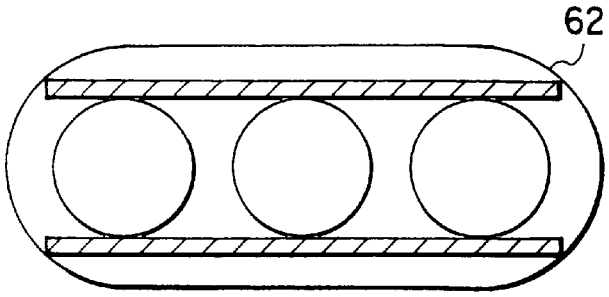
Figure 7C:
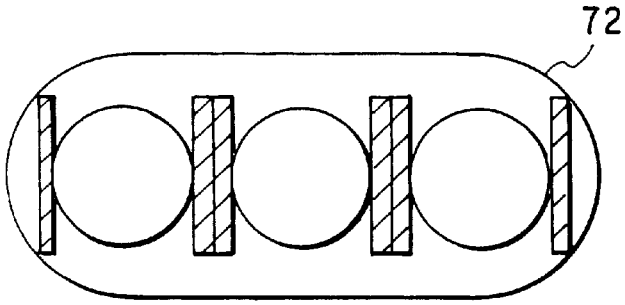
Figure 7D:
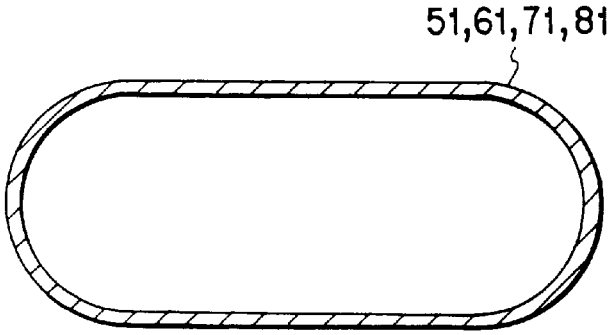

The first grid 1 is a thin plate-like electrode provided with three electron beam holes each having a small diameter. The second grid 2 is also a thin plate-like electrode provided with three electron beam holes each having a small diameter. The third grid 3 is a combination of a cup-shaped electrode and a thick plate-like electrode. Three electron beam holes slightly larger in diameter than the electron beam holes formed in the second grid 2 are formed in the third grid 3 on the side of the second grid 2, and three electron beam holes each having a large diameter are formed in the third grid 3 on the side of the fourth grid 4. The fourth grid 4 consists of two cup-shaped electrodes whose free ends are allowed to abut against each other. Each of these cup-shaped electrodes is provided with three electron beam holes each having a large diameter. The fifth grid 5 includes two cup-shaped electrodes that are long in the electron beam running direction, a plate-like electrode 52 and a cylindrical electrode 51 having an aperture common with the three electron beams and constructed as shown in FIG. 7D. The fifth grid 5 is shaped as shown in FIG. 7A, if viewed from the sixth grid 6. The sixth grid 6 includes a cylindrical electrode 61 shaped as shown in FIG. 7D and having an aperture common with the three electron beams and a plate-like electrode 62 provided with three electron beam holes. Eaves-shaped electrodes extending in the running direction of the electron beams are formed on the upper and lower sides of the three electron beam holes as shown in FIG. 7B. These eaves-shaped electrodes are formed integral with the plate-like electrode 62 on the side of the seventh grid 7.

The seventh grid 7 includes a plate-like electrode 72 and a cylindrical electrode 71. As shown in FIG. 7C, eaves-shaped electrodes extending in the running direction of the electron beam are formed integral with the plate-like electrode 72 on the right and left sides of each of the three electron beam holes. On the other hand, the cylindrical electrode 71 has an aperture common with the three electron beams, as shown in FIG. 7D. Because of the particular construction, a strong quadrupole lens is formed between the sixth and seventh grids 6 and 7. Further, the eighth grid 8 includes a cylindrical electrode 81 having an aperture common with the three electron beams as shown in FIG. 7D and a plate-like electrode 82 provided with three electron beam holes. The eighth grid 8 is shaped as shown in FIG. 7A if viewed from the seventh grid 7.

A voltage (Ek) of about 100 to 200V is applied across each of the three cathodes KG, KB, KR, and the first grid 1 is connected to the ground. A voltage (Ec2) of about 600 to 800V is applied between the second grid 2 and the fourth grid 4. A focusing voltage (Vf+Vd) of about 6 to 10 kV that is changed in synchronism with the deflecting magnetic field is applied to each of the third grid 3 and the fifth grid 5. An anode voltage (Eb) of about 25 to 34 kV is applied to the eighth grid 8. A voltage substantially intermediate between the voltages applied to the fifth grid 5 and the eighth grid 8 is applied to the seventh grid 7 by resistor 100 arranged in the vicinity of the electron gun. Resistor 100 comprises resistors 101, 102, and 103. Further, a voltage is supplied from the seventh grid 7 to the sixth grid 6 via resistor 103. In this fashion, a lens system with an expanded electric field is formed by the intermediate electrodes, i.e., the sixth grid 6 and the seventh grid 7, interposed between the fifth grid 5 and the eighth grid 8. Since the lens system thus formed constitutes a large diameter lens having a long focus, the electron beam forms a smaller electron beam spot on the screen.

Figure 8:
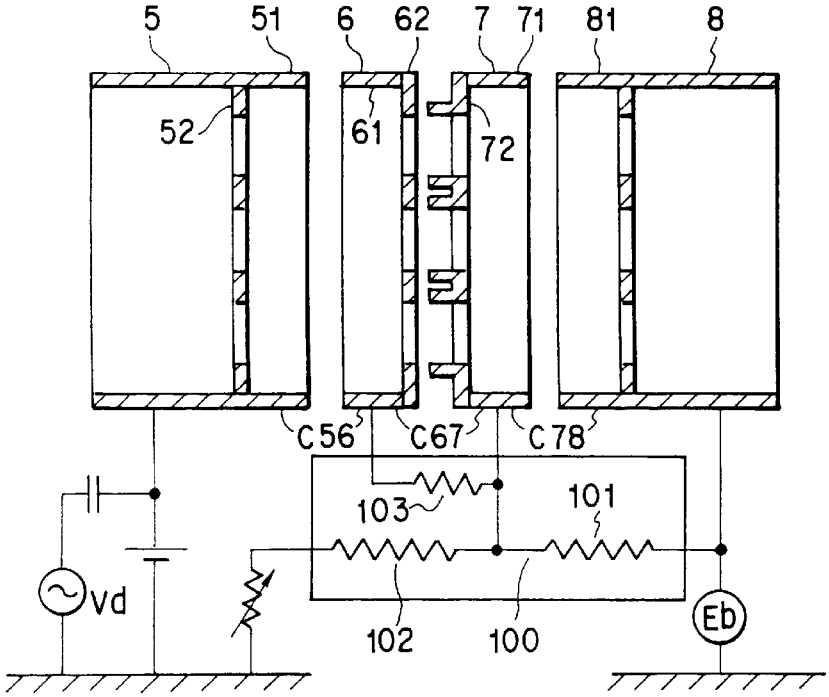
FIG. 8 shows in detail the construction of the electrode constituting the main lens portion of the electron gun shown in FIG. 6 and the circuit including the electrode construction.
Figure 9:
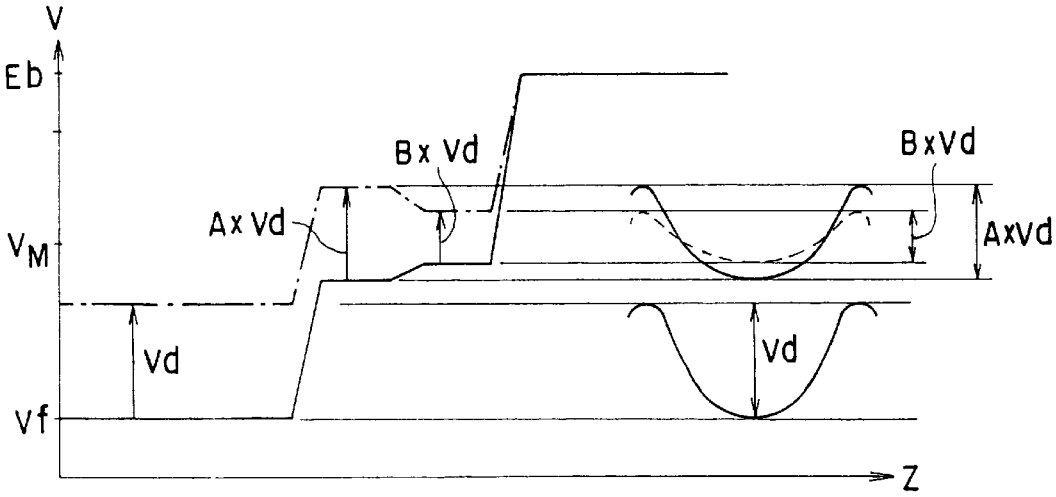
FIG. 9 is a graph showing the voltages applied to the electrodes shown in FIG. 8 and the changes of these voltages.

FIG. 8 schematically shows the construction of the main lens portions 5 to 8 according to one embodiment of the present invention. On the other hand, FIG. 9 is a graph showing the voltages applied to the electrodes shown in FIG. 8. In the graph of FIG. 9, the voltage level is plotted on the ordinate, with the position along the tube axis being plotted on the abscissa. The voltage distribution denoted by a solid line in FIG. 9 covers the case where the electron beams are directed toward the center of the screen. Also, a dash-and-dot line in FIG. 9 denotes the voltage distribution in the case where the electron beams are directed toward the periphery of the screen. A parabolic dynamic voltage Vd relative to the focus voltage Vf is applied to the fifth grid 5, and an anode voltage Eb is applied to the eighth grid 8.

Figure 11:
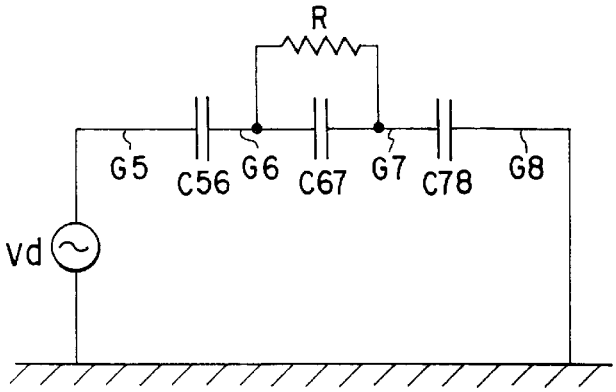
FIG. 11 is an AC-wise equivalent circuit of the electrode shown in FIG. 8.

The anode voltage Eb is divided by a resistor 100 arranged within the tube. As a result, an intermediate voltage VM higher than the focus voltage Vf applied to the fifth grid 5 and lower than the anode voltage Eb applied to the eighth grid 8 is applied to the sixth grid 6 and the seventh grid 7 arranged between the fifth grid 5 and the eighth grid 8. Also, the parabolic dynamic voltage Vd supplied to the fifth grid 5, which is changed in synchronism with the deflecting magnetic field, is divided by a capacitance C56 between the fifth grid 5 and the sixth grid 6, a capacitance C67 between the sixth grid 6 and the seventh grid 7 and a capacitance C78 between the seventh grid 7 and the eighth grid 8, and the divided dynamic voltage is overlapped with the intermediate voltage VM. As a result, AC voltages of A×Vd and B×Vd are applied together with the intermediate voltage VM to the sixth grid 6 and the seventh grid 7, respectively, as shown in FIG. 9. These constants A and B can be determined by resolving the equivalent AC circuit shown in FIG. 11, as follows.

Overlapping Voltage (AC component) Applied to the Sixth Grid 6: A×Vd $$A=C56\cdot(C78+C67)/(C56\cdot C67+C67\cdot C78+C78\cdot C56)$$

Overlapping Voltage (AC component) Applied to the Seventh Grid 7: B×Vd $$B=C56\cdot C67/(C56+C67+C67\cdot C78+C78\cdot C56)$$

Figure 10:
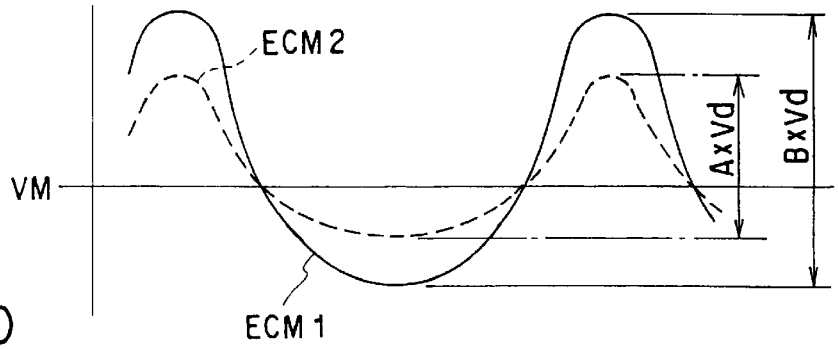
FIG. 10 is a graph showing the waveforms of the voltages applied to the electrodes shown in FIG. 8.

As described above, the dynamic voltage Vd is applied to the fifth grid 5. Also, the overlapping voltages A×Vd and B×Vd are applied to the sixth and seventh grids 6 and 7, respectively. To be more specific, voltages that are changed in synchronism with the deflecting magnetic field as shown in FIG. 10 are applied to the sixth grid 6 and the seventh grid 7. It follows that the lens function of the electric field lens formed between adjacent electrodes is changed in synchronism with the deflecting magnetic field.

Figure 12:
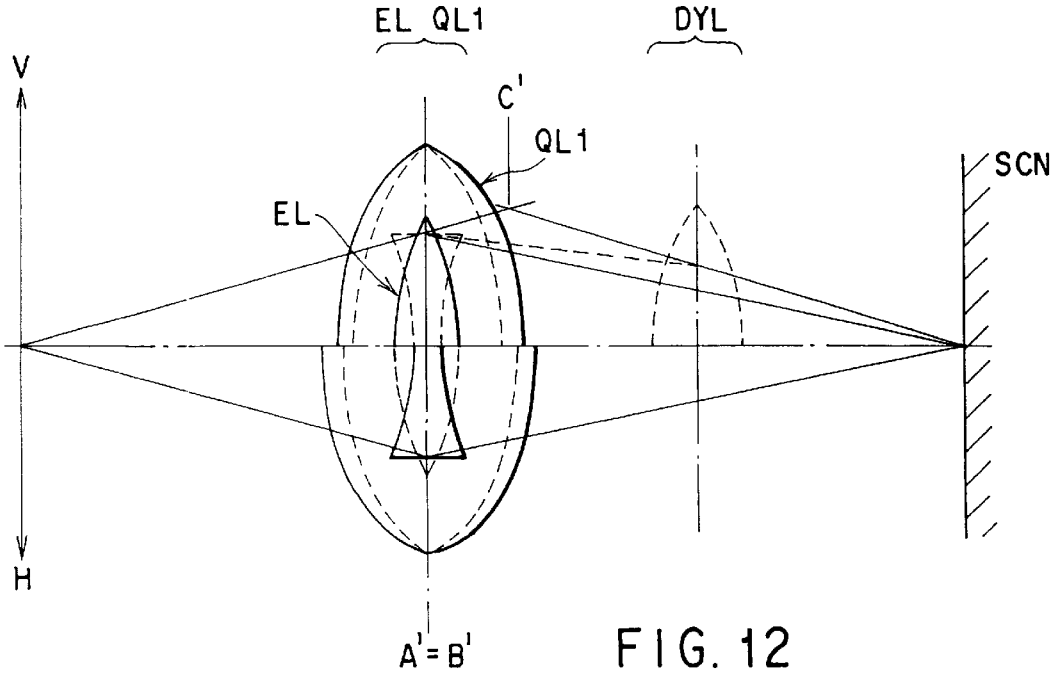
FIG. 12 shows the operation of the electron lens of the electron gun mounted to a cathode ray tube according to one embodiment of the present invention.

FIG. 12 shows the lens function performed by the main electron lens EL. As shown in FIG. 12, a quadrupole lens QL1 is positioned in substantially the central portion of the main electron lens EL in the electron gun of the present invention. When the electron beam is deflected from the center of the screen toward the periphery of the screen, the dynamic voltage Vd is applied to the fifth grid 5. Also, the electric field expansion type main electron lens EL formed between the fifth grid 5 and the eighth grid 8, mainly from the first lens region formed between the fifth grid 5 and the sixth grid 6 to the third lens region formed between the seventh grid 7 and the eighth grid 8, is weakened from the state denoted by a solid line to the state denoted by a broken line. Further, the lens function of the quadrupole lens QL1 in the second lens region formed between the sixth grid 6 and the seventh grid 7 is changed by a difference in voltage between the AC voltage of A×Vd applied to the sixth grid 6 and the AC voltage of B×Vd applied to the seventh grid 7, which are shown in FIG. 9. It follows that, when the electron beams are directed to the center of the screen, the quadrupole lens QL1 performs the diverging and focusing functions in the horizontal and vertical directions as denoted by a solid line in FIG. 12. Also, when the electron beams are deflected toward the periphery of the screen, the quadrupole lens QL1 performs the focusing and diverging functions in the horizontal and vertical directions as denoted by a broken line in FIG. 12. Because of this change in the lens function, the lens function in the horizontal direction of the main electron lens EL and the lens function in the horizontal direction of the quadrupole lens QL1 cancels each other, with the result that the overall focusing force in the horizontal direction of the entire main lens (all of the first, second and third lens regions) is substantially maintained.

The orbit in the vertical direction of the electron beam is as denoted by a broken line in FIG. 12. On the other hand, the orbit in the horizontal direction of the electron beam is as in the case where the electron beams are focused on the center of the screen because the position of the quadrupole lens and the position of the main electron lens are substantially coincident with each other.

Figure 1:
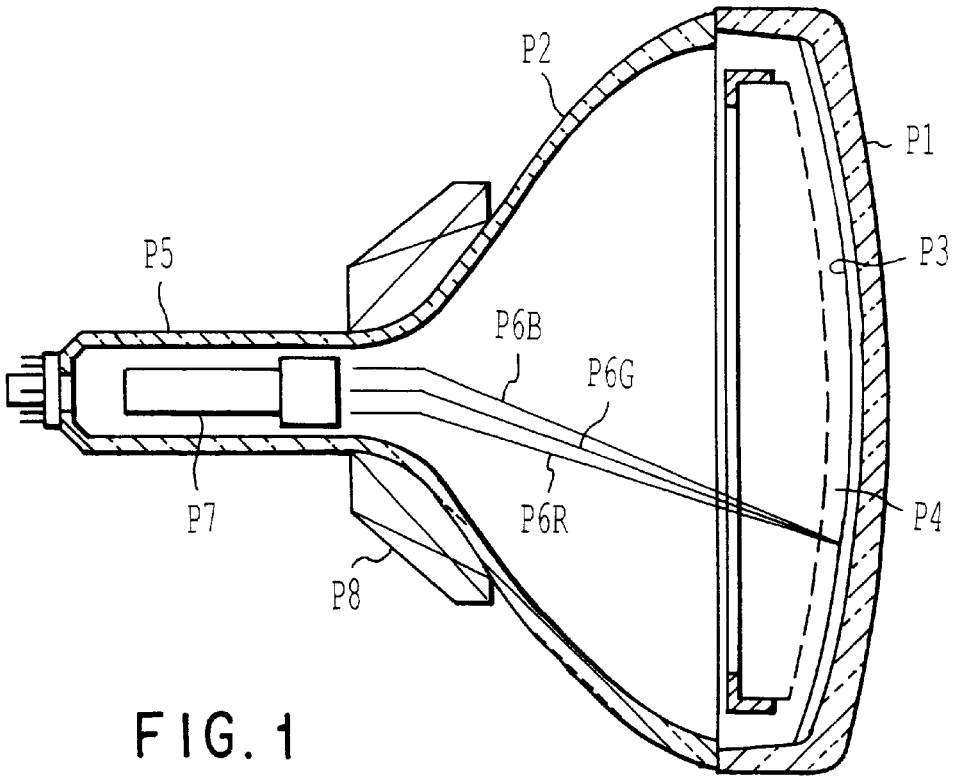
FIG. 1 is a cross sectional view schematically showing a general cathode ray tube.
Figure 2A:
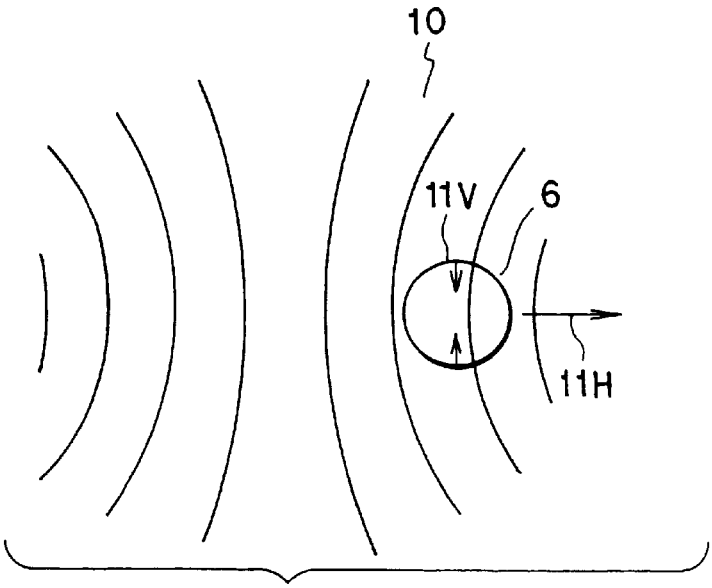
FIGS. 2A and 2B are for explaining the lateral collapse of an electron beam caused by a pin cushion type deflection magnetic field.
Figure 2B:
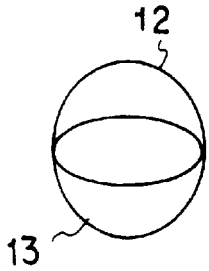
Figure 3:
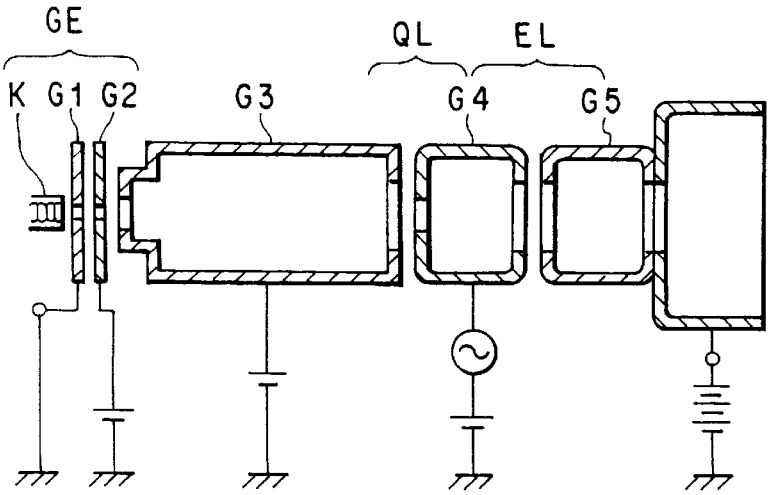
FIG. 3 schematically shows the construction of the electron gun of the cathode ray tube shown in FIG. 1 and the circuit construction of the peripheral circuit.
Figure 4A:
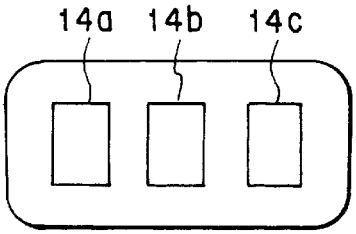
FIGS. 4A and 4B are plan views each showing the shapes of the electrodes included in the electron gun shown in FIG. 3.
Figure 4B:
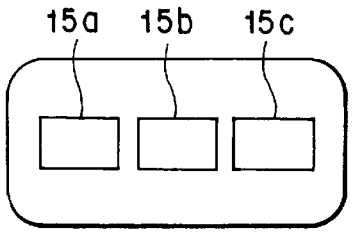
Figure 5:
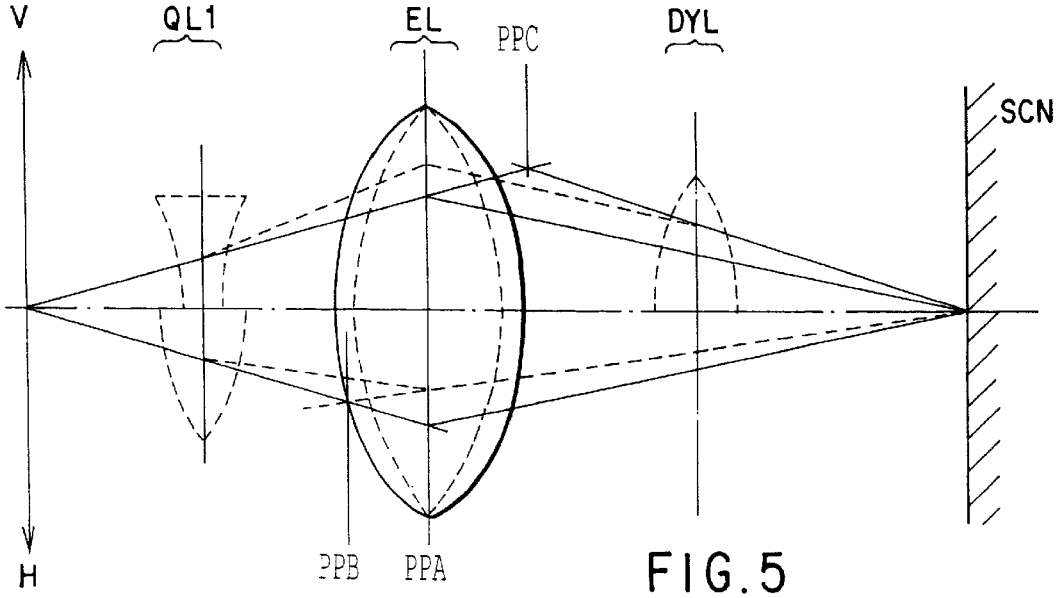
FIG. 5 shows the lens operation of the electron gun included in the cathode ray tube shown in FIG. 1.

Therefore, the principle plane of the lens (imaginary center of lens, i.e., cross point between the orbit of the beam emitted from the electron gun and the orbit of the beam incident on the screen) for focusing the electron beam in the horizontal direction (H) at the time when the electron beam is in the center of the screen is equal to that at the time when the electron beam is deflected toward the periphery of the screen (principle plane A'=principle plane B'). In the vertical direction, i.e., within a vertical plane, the position of the principle plane is moved forward by the generation of a DY lens. In the conventional electron gun, the quadrupole lens QL1 is positioned closer to the cathode than the main electron lens EL, as shown in FIG. 5. The electron beam is diverged by the quadrupole lens in the vertical direction, i.e., within a vertical plane, and the orbit of the electron beam extends through a point away from the axis of the main electron lens EL to cause the position C of the principle plane to be moved forward. In the electron gun of the present invention, however, the quadrupole lens QL1 is formed within the main electron lens EL. As a result, the orbit of the electron beam incident on the main electron lens EL remains unchanged and, thus, the principle plane C' in the vertical direction is moved to a position closer to the cathode than the principle plane C of the conventional electron gun. As a result, the magnification in the vertical direction is not larger than that in the conventional electron gun and, thus, the vertical diameter of the electron beam is not appreciably collapsed in the periphery of the screen.

Therefore, the amounts of deviation in the positions of the principle planes in the horizontal and vertical directions at the periphery of the screen are smaller in the electron gun of the present invention than in the conventional electron gun (magnifications in the vertical and horizontal directions are poor and satisfactory, respectively). As a result, the phenomenon of the lateral collapse of the electron beam at the periphery of the screen is suppressed to make it possible to obtain an electron beam having a substantially circular cross section. In other words, the electron gun specified in the present invention makes it possible to obtain a cathode ray tube free from a lateral collapse of the electron beam at the periphery of the screen and exhibiting a satisfactory resolution over the entire region of the screen.

Further, where the electrostatic capacitance C56 between the fifth grid 5 and the sixth grid 6 is set equal to the electrostatic capacitance C78 between the seventh grid 7 and the eighth grid 8 (C56=C78), and the electrostatic capacitance C67 between the sixth grid 6 and the seventh grid 7 is set at $\alpha C$ ($\alpha<1$), the overlapping voltage A×Vd of the sixth grid 6 and the overlapping voltage B×Vd of the seventh grid 7 are:

Overlapping voltage (AC component) of the sixth grid 6: A×Vd $$A=\alpha/(1+2\alpha)C^2$$

Overlapping voltage (AC component) of the seventh grid 7: B×Vd $$B=\alpha/(1+2\alpha)C^2$$

It follows that the potential difference (A-B)×Vd between the sixth grid 6 and the seventh grid 7 is:

$$(A-B)\times vd=1/(1+2\alpha)C^2\times Vd$$

It should be noted that, where $\alpha$ is smaller than 1, the potential difference between the sixth grid 6 and the seventh grid 7 can be increased. In other words, the potential difference noted above can be increased where the electrostatic capacitance C67 between the sixth grid 6 and the seventh grid 7 is smaller than any of the electrostatic capacitance C56 between the fifth grid 5 and the sixth grid 6 and the electrostatic capacitance C78 between the seventh grid 7 and the eighth grid 8 and with increase in the difference between the electrostatic capacitance C67 and any of the electrostatic capacitance C56 and the electrostatic capacitance C78. As a result, the AC voltage component applied to the fifth grid 5 can be utilized effectively for formation of the quadrupole lens between the fifth grid 5 and the sixth grid 6 and for operation of the quadrupole lens so as to diminish the AC voltage component applied to the fifth grid 5.

It should also be noted that the anode voltage Eb applied to the eighth grid 8 is divided by the resistor 100 arranged in the vicinity of the electron gun, and the divided voltage is applied to each of the sixth grid 6 and the seventh grid 7. Therefore, an extra voltage need not be applied from outside the cathode ray tube, making it possible to realize easily a cathode ray tube of a high quality as described above.

Figure 13:
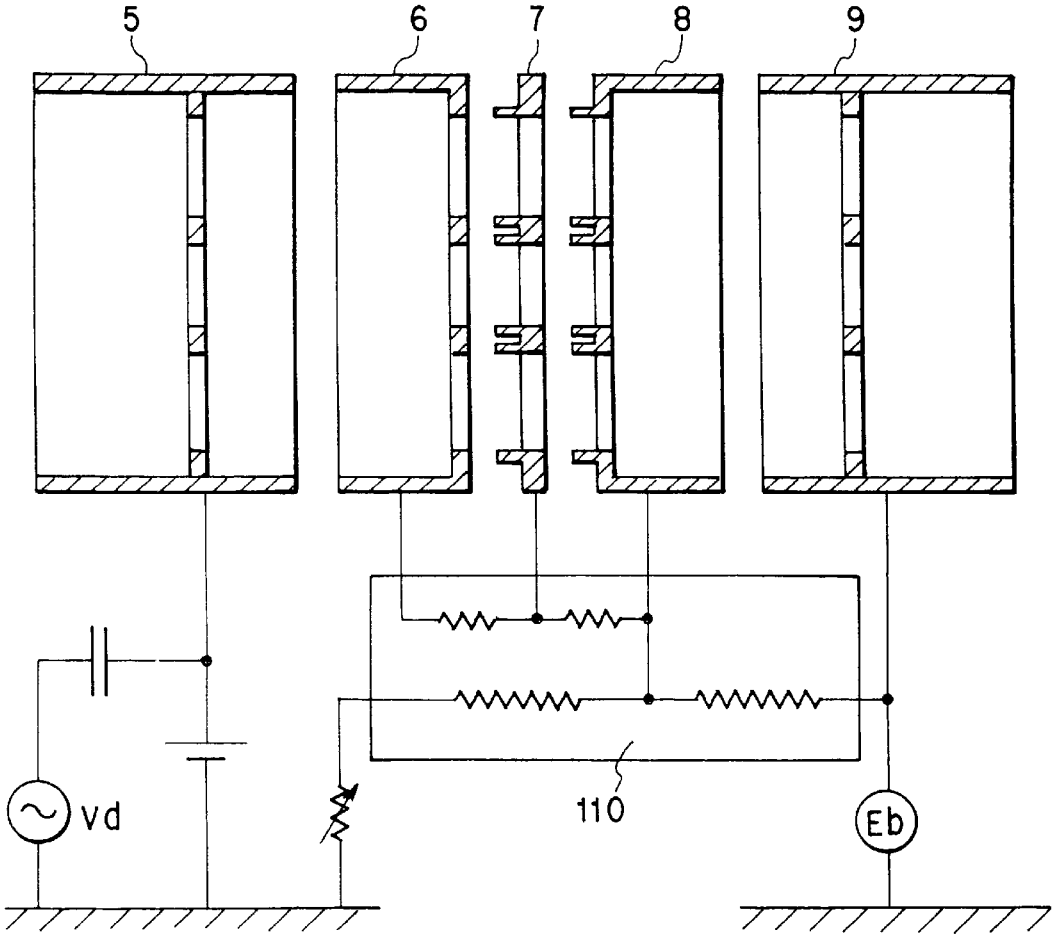
FIG. 13 shows in detail the construction of the electrode constituting the main lens portion of the electron gun mounted to a cathode ray tube according to another embodiment of the present invention and the circuit including the electrode structure.

FIG. 13 shows a second embodiment of the present invention. Specifically, FIG. 13 schematically shows the construction and arrangement of the grids 5 to 9 constituting the main lens portion of the electron gun included in the cathode ray tube according to the second embodiment of the present invention. A parabolic dynamic voltage Vd based on a DC focus voltage Vf is applied to the fifth grid 5, and an anode voltage Eb is applied to the ninth grid 9. The anode voltage Eb is divided by a resistor 110 arranged within the tube. Therefore, an intermediate voltage MV higher than the focus voltage Vf applied to the fifth grid 5 and lower than the anode voltage Eb applied to the ninth grid 9 is applied to the sixth, seventh and eighth grids 6, 7, 8 interposed between the fifth grid 5 and the ninth grid 9. Also, a parabolic dynamic voltage Vd supplied to the fifth grid 5, which is changed in synchronism with the deflecting magnetic field, is divided by a capacitance C56 between the fifth grid 5 and the sixth grid 6, a capacitance C67 between the sixth grid 6 and the seventh grid 7, a capacitance C78 between the seventh grid 7 and the eighth grid 8 and a capacitance C89 between the eighth grid 8 and the ninth grid 9, and the divided dynamic voltage is overlapped with the intermediate voltage VM, as in the first embodiment. As a result, AC voltages are applied together with the intermediate voltage VM to the sixth grid 6, the seventh grid 7 and the eighth grid 8, respectively, as shown in FIG. 13.

As described above, the dynamic voltage Vd is applied to the fifth grid 5. Also, an overlapping voltage determined by the electrostatic capacitance between adjacent grids is applied to each of the six grid 6, the seventh grid 7, and the eighth grid 8. Also, the lens function of the electric field lens formed between adjacent grids is changed in synchronism with the deflecting magnetic field. To be more specific, the lens function of the main electron lens is changed as shown in FIG. 12, as in the first embodiment described previously. Also, the quadrupole lens QL1 is formed in the vicinity of the center of the main electron lens EL. When the electron beam is deflected from the center toward the periphery of the screen, the dynamic voltage Vd is applied to the fifth grid 5. Also, the electric field expanding type main electron lens EL is weakened from the state denoted by a solid line to the state denoted by a broken line by a first lens region formed between the fifth grid 5 and the sixth grid 6 and by a third lens region formed between the eighth grid 8 and the ninth grid 9. Further, the lens function of the quadrupole lens QL1 in the second lens region formed among the sixth grid 6, the seventh grid 7 and the eighth grid 8 is changed by the difference in voltage among the AC voltages overlapped on the sixth, seventh and eighth grids. When the electron beam is deflected toward the periphery of the screen, the lens function of the quadrupole lens QL1 is changed to exhibit a focusing function in the horizontal direction and a diverging function in the vertical direction as denoted by broken lines. By this change in the lens function, the lens function of the main electron lens EL in the horizontal direction and the lens function of the quadrupole lens QL1 in the horizontal direction cancel each other, with the result that the overall focusing function in the horizontal direction of the entire main lens (all of the first, second and third lens regions) is substantially maintained.

The orbit in the vertical direction of the electron beam is as denoted by a broken line in FIG. 12. On the other hand, the orbit in the horizontal direction of the electron beam is as in the case where the electron beams are focused on the center of the screen because the position of the quadrupole lens and the position of the main electron lens are substantially coincident with each other.

Therefore, the principle plane of the lens (imaginary center of lens, i.e., cross point between the orbit of the beam emitted from the electron gun and the orbit of the beam incident on the screen) for focusing the electron beam in the horizontal direction (H) at the time when the electron beam is in the center of the screen is equal to that at the time when the electron beam is deflected toward the periphery of the screen (principle plane A'=principle plane B'). In the vertical direction, the position of the principle plane is moved forward by the generation of a DY lens. In the conventional electron gun, the quadrupole lens QL1 is positioned closer to the cathode than the main electron lens EL, as shown in FIG. 5. The electron beam is diverged by the quadrupole lens in the vertical direction, and the orbit of the electron beam extends through a point away from the axis of the main electron lens EL to cause the position C of the principle plane to be moved forward. In the electron gun of the present invention, however, the quadrupole lens QL1 is formed within the main electron lens EL. As a result, the orbit of the electron beam incident on the main electron lens EL remains unchanged and, thus, the principle plane C' in the vertical direction is moved to a position closer to the cathode than the principle plane C of the conventional electron gun. As a result, the magnification in the vertical direction is not larger than that in the conventional electron gun and, thus, the vertical diameter of the electron beam is not appreciably collapsed in the periphery of the screen.

Therefore, the amounts of deviation in the positions of the principle planes in the horizontal and vertical directions at the periphery of the screen are smaller in the electron gun of the present invention than in the conventional electron gun (magnifications in the vertical and horizontal directions are poor and satisfactory, respectively). As a result, the phenomenon of the lateral collapse of the electron beam at the periphery of the screen is suppressed to make it possible to obtain an electron beam having a substantially circular cross section. In other words, the construction of the main lens in the second embodiment makes it possible to obtain a cathode ray tube free from a lateral collapse of the electron beam at the periphery of the screen and exhibiting a satisfactory resolution over the entire region of the screen like the cathode ray tube of the first embodiment.

Each of the embodiments described above is directed to an electron gun having a QPF structure. However, it is apparent that the similar effects can be obtained as far as the electron gun has the similar main lens structure, even if the QPF structure is not employed in the electron gun.

INDUSTRIAL APPLICABILITY

As described above, the present invention provides a cathode ray tube, comprising at least an electron beam forming section for forming and emitting at least one electron beam, an electron gun for accelerating and focusing the electron beam and having a main electron lens portion, and a deflection yoke for generating a deflecting magnetic field for deflecting the electron beam emitted from the electron gun in horizontal and vertical directions on a screen to have the screen scanned by the deflected electron beam, wherein:

said main electron lens portion consists of at least four electrodes arranged in the order of first, second, third and fourth grids;

an intermediate first voltage is applied to the first grid and an anode voltage is applied to the fourth grid;

the second and third grids that are positioned adjacent to each other are connected to each other via a resistor;

second and third voltages higher than the first voltage and lower than the anode voltage are applied to the second and third grids, respectively;

these first to fourth grids are arranged such that a second electrostatic capacitance between the second and third grids is smaller than any of a first electrostatic capacitance between the first and second grids and a third electrostatic capacitance between the third and fourth grids;

a first lens region is formed between the first and second grids;

a third lens region is formed between the third and fourth grids;

a second lens region is formed between the second and third grids; and an asymmetric lens is formed in the second lens region.

In the cathode ray tube of the construction described above, a quadrupole lens QL1 is formed in a central portion of the main lens EL. Therefore, the electron beam orbit in the horizontal direction remains unchanged whether the electron beam is directed to the center of the screen or is deflected toward a periphery of the screen. In other words, the principle plane of the lens for focusing the electron beam in the horizontal direction (H) (imaginary center of the lens, i.e., the cross point between the orbit of the electron beam emitted from the electron gun and the orbit of the electron beam incident on the screen) remains unchanged whether the electron beam is directed to the center of the screen or is deflected toward a periphery of the screen (principle plane A'=principle plane B'). Therefore, it is possible to moderate the lateral collapse phenomenon of the electron beam in the periphery of the screen, which is caused by the backward movement of the principle plane in the horizontal plane in the conventional electron gun.

Also, the anode voltage applied to the fourth grid is divided by the resistor arranged in the vicinity of the electron gun, and the divided voltage is applied to each of the second and third grids. This makes it unnecessary to apply an extra voltage from outside the cathode ray tube so as to provide easily a cathode ray tube of a high quality described above.

It should also be noted that an AC voltage component is applied to the first grid. As a result, an AC voltage is overlapped with the DC voltage applied to each of the second and third grids via the electrostatic capacitance between adjacent electrodes. What should be noted is that a quadrupole lens is formed within the main lens between the second and third grids by the potential difference generated in this stage between the second and third grids.

Further, since the electrostatic capacitance between the second and third grids is smaller than any of the electrostatic capacitance between the first and second grids and the electrostatic capacitance between the third and fourth grids, the AC component generated by the AC component applied to the first grid and applied to the second grid is larger than that in the case where the electrostatic capacitance between the second and third grids is equal to or larger than any of the electrostatic capacitance between the first and second grids and the electrostatic capacitance between the third and fourth grids. Also, the AC component generated by the AC component applied to the first grid and applied to the third grid is diminished. Therefore, the potential difference between the second and third grids is increased. It follows that the AC voltage component applied to the first grid can be effectively utilized for formation and operation of the quadrupole lens formed between the second and third grids so as to diminish the AC component applied to the first grid.

Further, it is possible to arrange at least three additional grids forming a second asymmetric lens region in the main lens noted above. These additional grids are successively arranged from the cathode toward the screen, and a voltage higher than the intermediate first voltage and lower than the anode voltage is applied to these additional grids. If these additional grids are constructed and arranged such that sum of the electrostatic capacitance values between adjacent additional grids is smaller than any of the electrostatic capacitance between the first grid and the additional grid adjacent to the first grid and the electrostatic capacitance between the fourth grid and the additional grid adjacent to the fourth grid, it is possible to increase the potential difference between the second and third grids. It follows that the AC voltage component applied to the first grid can be effectively utilized for forming a quadrupole lens between the second and third grids and for operating the quadrupole lens thus formed.

What is claimed is:

1. A cathode ray tube, comprising:

an electron gun including an electron beam forming section for forming and emitting at least one electron beam and a main lens portion for accelerating and focusing the electron beam, said main electron lens portion including at least four electrodes in the order of first, second, third and fourth grids, the first and second grids being closely arranged and the third and fourth grids being closely arranged, and including a resistor connected to each of the second and third grids, and these first to fourth grids being constructed and arranged such that a second electrostatic capacitance between the second and third grids is smaller than any of a first electrostatic capacitance between the first and second grids and a third electrostatic capacitance between the third and fourth grids;

a deflection yoke generating a deflecting magnetic field for deflecting the electron beam emitted from the electron gun in horizontal and vertical directions to have the screen scanned by the electron beam;

means for generating an intermediate first voltage and an anode voltage; and means for generating a dynamic focusing voltage which is varied depending on the deflection of the electron beam;

wherein the intermediate first voltage and the dynamic focusing voltage are applied to the first grid, the anode voltage is applied to the fourth grid, the anode voltage is divided by the resistor to generate a second voltage and a third voltage that are higher than the first voltage and lower than the anode voltage, and the second and third voltages are applied to the second and third grids, respectively, said second and third voltages being substantially same potential; and a first lens region is formed between the first and second grids, a third lens region is formed between the third and fourth grids, a second lens region is formed between the second and third grids, and an asymmetric lens is formed in the second lens region.

2. A cathode ray tube according to claim 1, wherein the electron gun further includes a fifth grid connected to the resistors and arranged between the second and third grids, the second, third and fifth grids forming the asymmetric lens in said second lens region, divided voltages higher than the intermediate first voltage and lower than the anode voltage are applied to the second, third and fifth grids, and the second, third and fifth grids are constructed and arranged such that the sum of the electrostatic capacitance values between the second and fifth grids and between the third and fifth grids is smaller than either of the first and second electrostatic capacitances.

* * * * *